US005130755A

United States Patent [19]

Ikegawa et al.

[11] Patent Number: 5,130,755

[45] Date of Patent: Jul. 14, 1992

[54] CLEANING DEVICE

[75] Inventors: Akihito Ikegawa; Toshiya Natushara; Hiroshi Mizuno; Yuji Enoguchi, all of Osaka, Japan

[73] Assignee: Minolta Camera Kabushiki Kaisha, Osaka, Japan

[21] Appl. No.: 626,242

[22] Filed: Dec. 12, 1990

Related U.S. Application Data

[63] Continuation of Ser. No. 330,274, Mar. 29, 1989, abandoned.

[30] Foreign Application Priority Data

Mar. 30, 1988 [JP] Japan ..... 63-78450

[51] Int. Cl.[5] ..... G03G 21/00

[52] U.S. Cl. ..... 355/296; 118/652; 355/298; 355/300

[58] Field of Search ..... 15/256.51, 256.52, 1.5; 430/125; 355/296, 297, 298, 300; 118/652, 653; 385/259, 253

[56] References Cited

U.S. PATENT DOCUMENTS 3,776,631 12/1973 Mammino ..... 355/300
4,311,780 1/1982 Mochizuki et al. ..... 118/652
4,530,595 7/1985 Itaya et al. .
4,530,596 7/1985 Kawamoto et al. ..... 118/652
4,579,440 4/1986 Katoh ..... 355/270 X
4,674,865 6/1987 Tada et al. ..... 118/652
4,739,370 4/1988 Yoshida et al. ..... 118/652
4,791,882 12/1988 Enoguchi ..... 118/653

FOREIGN PATENT DOCUMENTS 0046684 3/1982 European Pat. Off. ..... 355/296
0142370 11/1980 Japan ..... 355/270

*Primary Examiner*—A. T. Grimley
*Assistant Examiner*—Thu Dang
*Attorney, Agent, or Firm*—Burns, Doane, Swecker & Mathis

[57] ABSTRACT

A cleaning device which includes a driving roller, a thin film member in an endless belt configuration having a circumferential length slightly longer than that of the driving roller and applied over an outer peripheral face of the driving roller, and elastic members for pressing the thin film member against the driving roller. The thin film member depressed at its opposite ends by the elastic members forms a slackened portion through a space with respect to the surface of the driving roller so that the slackened portion contacts the surface of a photoreceptor drum for cleaning.

11 Claims, 2 Drawing Sheets

CLEANING DEVICE

This application is a continuation of application Ser. No. 07/330,274, filed Mar. 29, 1989 now abandoned.

BACKGROUND OF THE INVENTION

The present invention generally relates to a cleaning arrangement, and more particularly to a cleaning device used for removing residual toner on an image support member, for example, in an electrophotographic copying apparatus or the like.

Conventionally, a cleaning device for removing residual toner from the surface of an image support member in a copying apparatus or the like is arranged to effect the cleaning by causing a blade of a rubber material or the like to contact, under pressure, the surface of a photosensitive member such as an image support member for scraping off toner therefrom, or by rotating a roller of silicone rubber or the like contacting the photosensitive member or photoreceptor drum under pressure for removal of the toner. Although these known practices are superior, with the construction thereof generally simple, there is such a disadvantage that cleaning becomes imperfect due to slippage of toner between the blade and the surface of the image support member or fusion of toner undesirably takes place on the surface of the photosensitive member due to pressure exerted between the blade or rubber roller and the photosensitive member as the toner becomes spherical in shape and smaller in the particle size thereof as in the recent tendency.

In order to overcome the disadvantage as described above, there has also been proposed an arrangement in which a rubbing member in the form of a belt is adapted to rub against the photoreceptor drum for the image support member, over a predetermined width.

By way of example, the cleaning device disclosed in Japanese Patent Laid-Open Publication Tokkaisho No. 61-121076 is so arranged that, with a belt-shaped rubbing member contacting the surface of a photoreceptor drum under pressure, said rubbing member is moved at a speed different from that of the photoreceptor drum or stopped at the contacting position therebetween so as to rub against the photoreceptor drum surface, thereby to clean off corona products adhering to the surface of the photoreceptor drum as an image support member by the rubbing thereof. Meanwhile, the cleaning device described in Japanese Patent Laid-Open Publication Tokkaisho no. 62-11883 is provided with a belt-like cleaning sheet having a large number of projections on its surface for scraping off residual toner and movably disposed with respect to the photoreceptor drum surface so as to effect the cleaning by causing said cleaning sheet to contact said drum surface.

Each of the known cleaning devices as referred to above has a superior performance, since the contact area between the belt-like rubbing member and the image support member may be increased without being restricted by the material or hardness of the member to be pressed against the photoreceptor surface.

Incidentially, for depressing a such belt-like rubbing member onto the surface of the photoreceptor drum, it is generally required to pass the endless belt-like rubbing member around three rollers disposed to form a triangle, with the rubbing member between two of the three rollers being pressed against the photoreceptor drum surface to increase the contact area, and thus, the device inevitably tends to become large in size.

SUMMARY OF THE INVENTION

Accordingly, an essential object of the present invention is to provide a cleaning device compact in size to be disposed beside a photoreceptor drum in an electrophotographic copying apparatus or the like, and fully capable of cleaning with respect to toner small in particle diameter or spherical in shape.

Another object of the present invention is to provide a cleaning device of the above described type which is simple in construction and stable in functioning at high reliability, and can be readily incorporated into various copying apparatuses and the like at low cost.

In accomplishing these and other objects, according to one preferred embodiment of the present invention, there is provided a cleaning device which includes a driving roller, a thin film member in an endless belt configuration having a circumferential length slightly longer than that of said driving roller by a predetermined extent and applied over an outer peripheral face of said driving roller, and a pressing means for pressing said thin film member against said driving roller. The thin film member depressed at its opposite ends by said pressing means forms a slackened portion thereon through a space with respect to the surface of said driving roller so that the slackened portion contacts the surface of a photoreceptor drum for cleaning.

By the arrangement of the present invention as described above, the slackened portion of the thin film member contacts the photoreceptor surface extremely softly so as not to easily form any scratches, etc, thereon for promoting a prolonged life of the photoreceptor. Furthermore, the cleaning device according to the present invention displays a sufficient cleaning effect even with respect to small diameter toner particles or spherical toner particles, and thus, is the most suitable as a cleaner for a high precision developing toner.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
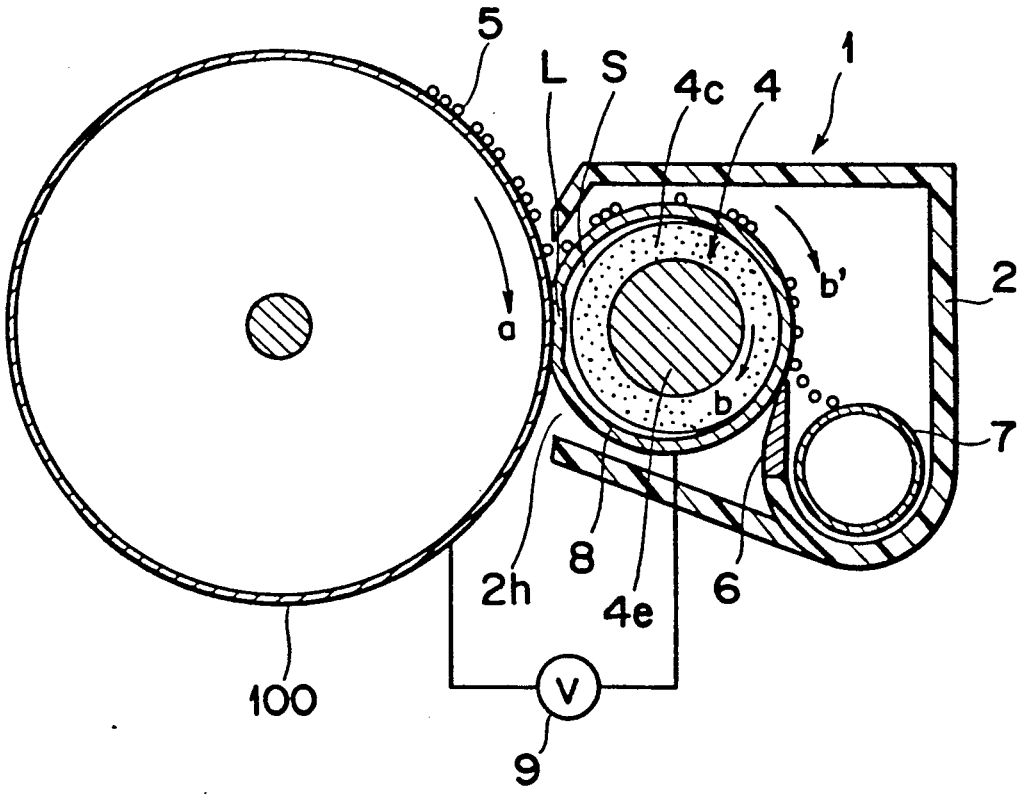
FIG. 1 is a side sectional view of the cleaning device according to one preferred embodiment of the present invention as disposed adjacent to a photoreceptor drum.

Before the description of the present invention proceeds, it is to be noted that like parts are designated by like reference numerals throughout the accompanying drawings.

Referring now to the drawings, there is shown in FIG. 1, a cleaning device 1 provided beside a photosensitive drum or a photoreceptor drum 100 driven for rotation in a direction indicated by an arrow a.

The cleaning device 1 generally includes a casing 2 open at its side **2*h* facing the surface of the photoreceptor drum 100, an elastic driving roller 4 rotatably provided in the casing 2 adjacent to the opening 2*h*, a thin film member 8 in an endless belt configuration having a circumferential length slightly longer than that of the driving roller 4, and applied over an outer peripheral face of the driving roller 4, and a pressing means 12 in the form of elastic pad members for pressing thin film member 8 against the driving roller 4**.

The elastic driving roller 4 is constituted by an electro-conductive member 4e of aluminum or the like as a core and an elastic member 4c of rubber or the like coated on the electro-conductive member 4e, and is impressed with a bias voltage from a power source 9. Accordingly, the elastic member 4c of rubber or the like at the upper layer is prepared by mixing carbon, etc., having a proper electro-conductivity into the rubber, etc. The thin film member 8 in the endless belt configuration has the circumferential length longer than that of the elastic driving roller 4, by a predetermined extent, and is applied externally around the peripheral surface of the driving roller 4 through an interval. This thin film member 8 formed into the endless cleaning belt configuration, for example, by a nickel electro-casting process, has a surface resistance less than $10^1\Omega$/cm.

Figure 2:
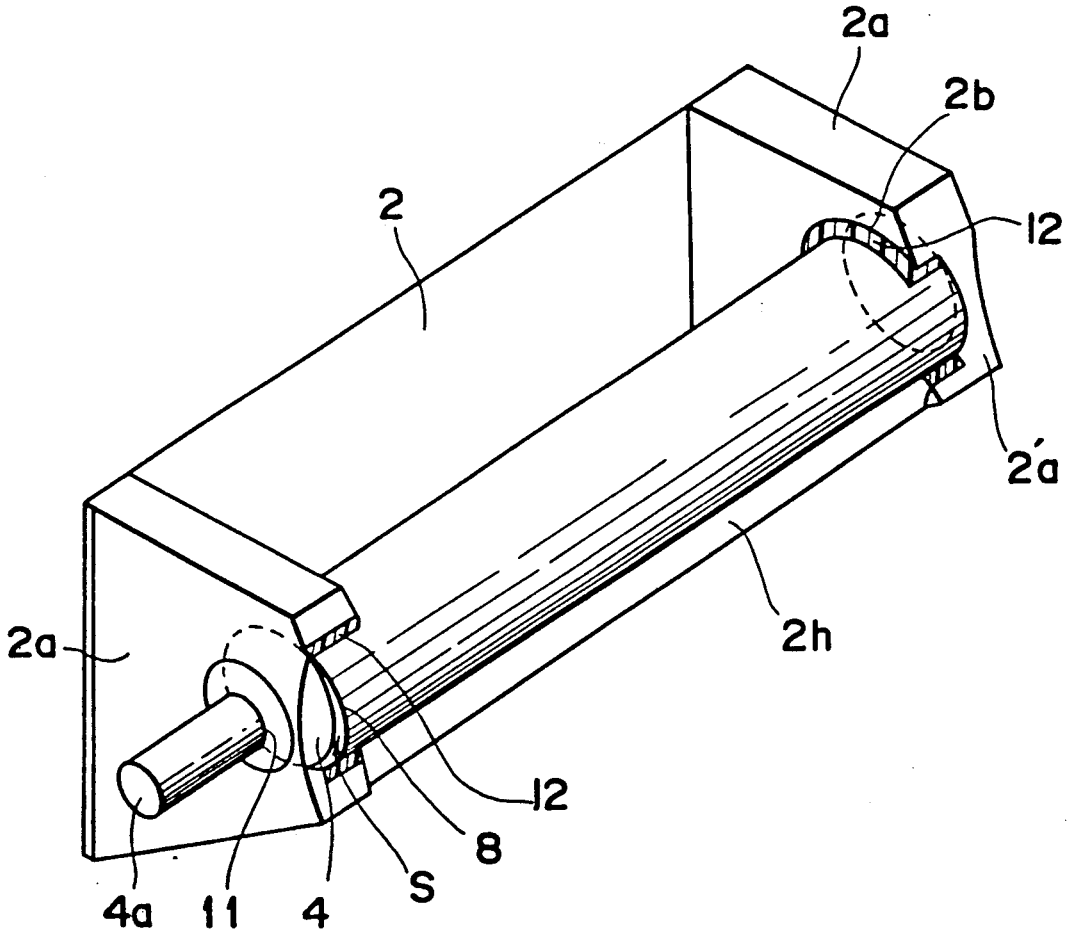
FIG. 2 is a perspective view of the cleaning device of FIG. 1 partly broken away to show a supporting state of an elastic driving roller employed therein.

As shown in FIG. 2, the elastic driving roller 4 is rotatably supported by its shaft 4a journaled in bearing holes 11 formed in side walls 2a of the casing 2 and coupled with a driving source (not shown) so as to be driven for rotation in the same direction b as the rotating direction a of the photoreceptor drum 100 and in a parallel relation with said photoreceptor drum. Moreover, the opposite end portions of the driving roller 4 are positioned in recesses 2b also formed in the side walls 2a, while the elastic pad members 12 are disposed for close contact between the recesses 2b and the thin film member 8 applied around the driving roller 4. Each of the elastic pad members 12 is prepared by a polyethylene, nylon or Teflon film or by an expanded material on which such a film is provided. The casing 2 is open at its front opening 2h confronting the photoreceptor drum 100, as stated earlier, and the elastic pad members 12 are not present at the corresponding front portions 2'a of the side walls 2a for the casing 2. (FIG. 2).

Accordingly, the thin film member 8 contacts the outer peripheral face of the elastic driving roller 4 at the portion where the elastic pad members 12 slide over said thin film member 8, and at the other portion, i.e. at the portion of the thin film member 8 located at the front faces 2'a of the side walls 2, the surplus length portion of said thin film member 8 which is formed to be rather longer than the circumferential length of the driving roller 4 is collected so as to form a slackened portion L having a space S with respect to the surface of the elastic driving roller 4, and this slackened portion L is supported to contact the peripheral surface of the photoreceptor drum 100.

It is to be noted here that the coefficients of friction for the elastic pad members 12, elastic driving roller 4, thin film member 8, and photoreceptor drum 100 at their respective contact portions should be so selected as to satisfy such a relation as represented by $$\mu 1 > \mu 2 + \mu 3$$

where the coefficient of dynamic friction between the outer peripheral surface of the elastic driving roller 4 and the thin film member 8 is denoted by $\mu 1$, that between the outer peripheral surface of the thin film member 8 and the elastic pad member 12 is $\mu 2$, and that between the outer peripheral surface of the thin film member 8 and the photoreceptor drum 100 is represented by $\mu 3$.

Therefore, upon rotation of the driving roller 4 in the direction indicated by the arrow b, the thin film member 8 follows the rotation thereof without causing any slippage with respect to said driving roller 4, ad the slackened portion L of the thin film member 8 covering the space S rubs softly against the surface of the photoreceptor drum 100 by a large nipping width, which should preferably be larger than 2 mm.

As shown in FIG. 1 there is further fixed a toner removing blade 6 within the casing 2 so as to contact the outer peripheral face of the thin film member 8 at its portion contacting the elastic driving roller 4 in a position opposite to the slackened portion L of said thin film member 8. The toner to be removed by this blade 6 is arranged to be sucked into a used toner transport pipe 7 provided at the right lower side of the casing 2 so as to be fed into a used toner bottle (not shown).

By the above arrangement, the thin film member 8 for the cleaning is moved in the same direction of an arrow b' following the rotation of the elastic driving roller 4 in the direction indicated by the arrow b in FIG. 1, and in this case, the thin film member 8 having the circumferential length longer than the driving roller 4 by the predetermined extent, forms the slackened portion L as it is depressed by the elastic pad members 12, and this portion L maybe positively held into contact with the peripheral surface of the photoreceptor drum 100 rotating in the direction of the arrow a through a large nipping width. Such contact is limited only to the slackened portion L of the thin film member 8 where the space S is present with respect to the surface of the driving roller 4, and thus, extremely soft contact is available thereat without any injury to the peripheral surface of the photoreceptor drum 100. Under the contacting state as described above, since the bias voltage opposite in polarity to that of the residual toner 5 on the surface of the photoreceptor drum 100 is applied to the thin film member 8 from the power source 9, the residual toner 5 is positively removed from the peripheral surface of the photoreceptor drum 100 onto the thin film member 8. It is to be noted here that in the present invention, although a bias voltage of −400 V was applied through employment of positively-charging toner, it may be so modified to properly set the bias voltage within a range of ±200 to 1000 V depending on necessity. The residual toner thus transferred onto the thin film member 8 is further scraped off therefrom by the toner removing blade 6 and is transported into the used toner bottle through the used toner transport pipe 7.

It should also be noted here that, in the foregoing embodiment, although the thin film member 8 is described as formed by the nickel electro-casting process, such thin film member may be modified to be formed by chromium or aluminum, and for example, prepared by a sheet composed of a base resin film of electro-conductive resin, polyethylene or the like having surface resistance of $10^5$ to $10^8\Omega$/cm, and a metallic thin layer of aluminum or the like laminated onto said base resin film. It should further be noted that, the rotational or moving direction of the thin film member is described to be the same as that of the photoreceptor drum, i.e., clockwise as shown in FIG. 1 (whereby the film member moves in a direction opposite that of the drum and thus moves relative to the drum). Alternatively, said thin film member may be moved in the reverse direction, and by the increase of the ratio of circumferential speed therebetween whereby there results relative movement therebetween), better cleaning performance may be achieved.

As is clear form the foregoing description, since the cleaning device according to the present invention is simply arranged to drive the thin film member by one elastic driving roller, it may be constructed in a small size, with a small driving force. Moreover, owing to the arrangement that the residual toner can be positively removed by causing the slackened portion of the thin film member to softly contact the surface of the photoreceptor drum, flaws or scratches are not readily formed on the photoreceptor surface, and thus, the life of the photoreceptor drum may be prolonged, while sufficient cleaning can be effected with respect to small diameter toner particles or spherical toner particles. Moreover, since a large permissible width or allowance may be available for the slackened portion of the thin film member, the allowance for the provision thereof is enlarged, with a consequent prolongation of the life for the thin film member, and thus, a compact cleaning device with a high cleaning performance can be advantageously presented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A cleaning device in combination with a driver image support member for removing residual toner from a surface of said image support member, said cleaning device comprising:

a rotatably driven roller confronting said image support member;

a thin film member in an endless belt configuration having a circumferential length slightly longer than that of said roller and loosely mounted on said roller; and supporting means for supporting said thin film member so as to rotate said thin film member in cooperation with the rotation of said roller and to form a slackened portion of said thin film member within a contacting region wherein said thin film member contacts said image support member, said roller being driven to produce relative movement between said slackened film member and said surface of said image support member within said contacting region, whereby said slackened portion contacting the surface of said image support member removes said residual toner from the surface of said image support member;

said supporting means supporting said thin film member so as to rotate said thin film member in frictional cooperation with the rotation of the roller, said supporting means producing a first frictional force between said thin film member and said roller which is greater than a sum of a second friction force between said thin film member and said supporting means, and a third friction force between said thin film member and said image support member.

2. A cleaning device as claimed in claim 1, wherein an electro-conductive member is employed for said thin film member.

3. A cleaning device as claimed in claim 2, wherein the electro-conductive member is a metallic thin film.

4. A cleaning device as claimed in claim 3, wherein said metallic thin film is formed by an electro-casting process.

5. A cleaning device as claimed in claim 2, wherein the electro-conductive member is a laminated member of a resin thin film and a metallic thin film.

6. A cleaning device as claimed in claim 1, wherein said thin film member is arranged to be applied with a bias voltage opposite in polarity to that of the toner.

7. A cleaning device as claimed in claim 1, wherein the roller is of an elastic rubber roller.

8. A cleaning device as claimed in claim 1, wherein toner removing member is provided in contact with the peripheral surface of said thin film member.

9. A cleaning device as claimed in claim 8, wherein the toner removing member is made of a blade member.

10. A cleaning device according to claim 1, wherein said thin film member is driven in a direction opposite said image support member within said contacting region.

11. A cleaning device according to claim 1, wherein said film member comprises a metallic film member, said supporting means comprising elastic members arranged to press opposite ends of said film member against said driven roller, bias voltage applying means for applying a bias voltage to said thin film member to remove said residual toner from the surface of said image support member and to transfer said removed toner onto said tin film member, and a toner scraping member for scraping said removed toner from the surface of said thin film member at a position where said thin film member contacts said driven roller.

* * * * *

UNITED STATES PATENT AND TRADEMARK OFFICE

CERTIFICATE OF CORRECTION

PATENT NO. : 5,130,755

DATED : July 14, 1992

INVENTOR(S) : Akihito IKEGAWA ET AL

It is certified that error appears in the above-identified patent and that said Letters Patent is hereby corrected as shown below:

On title page, item [75], delete "Natushara" and insert -- Natsuhara --.

Signed and Sealed this

Twenty-fourth Day of August, 1993

Bruce Lehman

*Attest:*

BRUCE LEHMAN

*Attesting Officer*

*Commissioner of Patents and Trademarks*